US011109690B2

(12) United States Patent
Giovingo

(10) Patent No.: US 11,109,690 B2
(45) Date of Patent: Sep. 7, 2021

(54) TWIN BABY CARRIER APPARATUS

(71) Applicant: Lauren Giovingo, Mt. Pleasant, SC (US)

(72) Inventor: Lauren Giovingo, Mt. Pleasant, SC (US)

( * ) Notice: Subject to any disclaimer, the term of this patent is extended or adjusted under 35 U.S.C. 154(b) by 0 days.

(21) Appl. No.: 16/450,229

(22) Filed: Jun. 24, 2019

(65) Prior Publication Data

US 2020/0015600 A1 Jan. 16, 2020

Related U.S. Application Data

(60) Provisional application No. 62/688,868, filed on Jun. 22, 2018.

(51) Int. Cl.

| | |
|---|---|
| ***A47D 13/00*** | (2006.01) |
| ***A47D 13/02*** | (2006.01) |
| ***A41B 13/06*** | (2006.01) |
| ***A41D 1/215*** | (2018.01) |
| *A45F 3/04* | (2006.01) |

(52) U.S. Cl.

CPC ..... *A47D 13/025* (2013.01); *A41B 13/06* (2013.01); *A41D 1/215* (2018.01); *A41D 2400/482* (2013.01); *A45F 2003/045* (2013.01)

(58) Field of Classification Search

CPC ..... A47D 13/025; A41D 1/215; A41D 2400/482; A41B 13/06; A45F 2003/045

USPC ..... 224/160

See application file for complete search history.

(56) References Cited

U.S. PATENT DOCUMENTS

| | | | | |
|---|---|---|---|---|
| 4,481,682 | A * | 11/1984 | Hall | A41F 3/00 2/304 |
| D307,821 | S | 5/1990 | Fallon | |
| 5,454,498 | A | 10/1995 | Dunn et al. | |
| 6,152,342 | A * | 11/2000 | Suk | A63B 55/408 224/259 |
| 6,179,175 | B1 * | 1/2001 | Painter | A45F 3/08 224/153 |
| 6,311,884 | B1 * | 11/2001 | Johnson | A45F 3/04 224/153 |
| 6,959,455 | B2 * | 11/2005 | Hall | A41F 19/00 2/340 |

(Continued)

OTHER PUBLICATIONS

Twins multifunctional baby carrier. AliExpress. Viewed online Oct. 24, 2019 at https://www.aliexpress.com/item/32707161382.

(Continued)

*Primary Examiner* — Peter N Helvey

(74) *Attorney, Agent, or Firm* — Gregory Finch; Finch Paolino, LLC

(57) ABSTRACT

An adjustable, body-worn twin baby carrier. Embodiments of the present disclosure provide for a novel twin baby carrier apparatus with improved ease of use for holding and removing two infant babies in the same carrier, compared to prior art solutions; and, novel twin baby carrier apparatus with an improved design for carrying two infant babies side-by-side against a user's chest, compared to prior art solutions. According to an embodiment of the present disclosure, a twin baby carrier apparatus is generally comprised of a body portion, right baby carrier portion, left baby carrier portion, right shoulder strap, left shoulder strap, and waist support portion.

6 Claims, 7 Drawing Sheets

(56) References Cited

U.S. PATENT DOCUMENTS

| | | | | |
|---|---|---|---|---|
| 7,178,632 | B2 * | 2/2007 | Casebolt | A62B 35/0037 119/770 |
| 7,979,919 | B2 * | 7/2011 | Joran | A62B 35/0018 2/69 |
| 9,038,868 | B2 | 5/2015 | Poiani | |
| 9,439,516 | B2 | 9/2016 | Workman | |
| 9,504,337 | B2 | 11/2016 | Workman | |
| D774,297 | S | 12/2016 | Workman | |
| 9,808,659 | B2 * | 11/2017 | Chevalier | A62B 35/04 |
| 9,848,713 | B2 | 12/2017 | Rosen et al. | |
| 10,610,002 | B2 * | 4/2020 | Pacha | A44B 11/00 |
| 2009/0302075 | A1 * | 12/2009 | Trainer | A47D 13/025 224/160 |
| 2012/0241487 | A1 * | 9/2012 | Zack | A47D 13/025 224/576 |
| 2012/0318833 | A1 * | 12/2012 | Zack | A47D 13/025 224/160 |
| 2014/0131401 | A1 * | 5/2014 | Workman | A47D 13/025 224/160 |
| 2015/0201761 | A1 * | 7/2015 | Wollenberg | A45F 4/02 224/576 |
| 2016/0270554 | A1 | 9/2016 | Silverman | |

OTHER PUBLICATIONS

Twin Baby Carrier. Weego. Viewed online Oct. 24, 2019 at https://weego.com/products/weego-twin.

Twin Baby Carrier. Malishastik. Viewed online Oct. 24, 2019 at https://www.fishpond.com.au/Baby/Blue-Baby-Carrier-Twins-Baby-Carrier-For-Twins-Twin-Carrier-Twin-Baby-Carrier-Baby-Twins-Baby-Carrier-Twins-Carrier/0602640362342.

Baby Carriers for Twins. Lucie's List. Viewed online Oct. 24, 2019 at https://www.lucieslist.com/twin-baby-carriers/.

Twintrexx 2 Twin Baby Carrier. Viewed online Oct. 24, 2019 at https://www.stuff4multiples.com/twintrexx-2-twin-baby-carrier/.

* cited by examiner

TWIN BABY CARRIER APPARATUS

CROSS-REFERENCE TO RELATED APPLICATIONS

This application claims the benefit of U.S. Provisional Application 62/688,868 filed Jun. 22, 2018, and hereby incorporated by reference herein in its entirety.

FIELD

The present disclosure relates to the field of baby carriers; in particular, an adjustable, body-worn twin baby carrier.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a novel twin baby carrier apparatus with enhanced ease of use for holding and removing two infant babies in the same carrier, compared to prior art solutions.

Another object of the present disclosure is a novel twin baby carrier apparatus with an improved design for carrying two infant babies side-by-side against a user's chest, compared to prior art solutions.

An aspect of the present disclosure includes a twin baby carrier apparatus comprising a body portion comprising a fabric panel, the body portion having a right breast access zipper and a left breast access zipper disposed thereon, and having a left medial connector means and a left lateral connector means disposed on an upper perimeter of the body portion, and a right medial connector means and a right lateral connector means disposed on the upper perimeter of the body portion; a right shoulder strap coupled to the upper perimeter of the body portion; a left shoulder strap coupled to the upper perimeter of the body portion; a waist support portion coupled to a lower portion of the body portion and configured to wrap around the waist of a user when worn; a right baby carrier portion comprising a fabric panel having an interior surface and an exterior surface, the right baby carrier portion being tapered in shape from a lower end to an upper end, the lower end being coupled to the body portion above the waist portion, the right baby carrier portion having a right medial support strap configured to be selectively coupled to the right medial connector means and a right lateral support strap configured to be selectively coupled to the right lateral connector means; and, a left baby carrier portion comprising a fabric panel having an interior surface and an exterior surface, the left baby carrier portion being tapered in shape from a lower end to an upper end, the lower end being coupled to the body portion above the waist portion, the left baby carrier portion having a left medial support strap configured to be selectively coupled to the left medial connector means and a left lateral support strap configured to be selectively coupled to the left lateral connector means.

Another aspect of the present disclosure provides for a baby carrier apparatus comprising a body portion having at least one breast access opening disposed thereon; a right shoulder strap coupled to the upper perimeter of the body portion; a left shoulder strap coupled to the upper perimeter of the body portion; a waist support portion coupled to a lower portion of the body portion and configured to wrap around the waist of a user when worn; a right baby carrier portion comprising a fabric panel having an interior surface and an exterior surface, the right baby carrier portion being tapered in shape from a lower end to an upper end, the lower end being coupled to the body portion above the waist portion, the right baby carrier portion being selectively coupled to an upper portion of the body portion; and, a left baby carrier portion comprising a fabric panel having an interior surface and an exterior surface, the left baby carrier portion being tapered in shape from a lower end to an upper end, the lower end being coupled to the body portion above the waist portion, the left baby carrier portion being selectively coupled to an upper portion of the body portion.

Yet another aspect of the present disclosure is a twin baby carrier apparatus comprising a body portion having at least one breast access opening disposed thereon; a right shoulder strap coupled to the upper perimeter of the body portion; a left shoulder strap coupled to the upper perimeter of the body portion; a shoulder strap connector extending between the right shoulder strap and the left shoulder strap, the shoulder strap connector comprising an adjustment tether being configured to enable a user to adjust a setting of the shoulder strap connector by pulling the adjustment tether with one hand; a waist support portion coupled to a lower portion of the body portion and configured to wrap around the waist of the user when worn; a right baby carrier portion being tapered in shape from a lower end to an upper end, the lower end being coupled to the body portion above the waist portion and the upper end being selectively coupled to an upper portion of the body portion; and, a left baby carrier portion being tapered in shape from a lower end to an upper end, the lower end being coupled to the body portion above the waist portion and the upper end being selectively coupled to an upper portion of the body portion.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
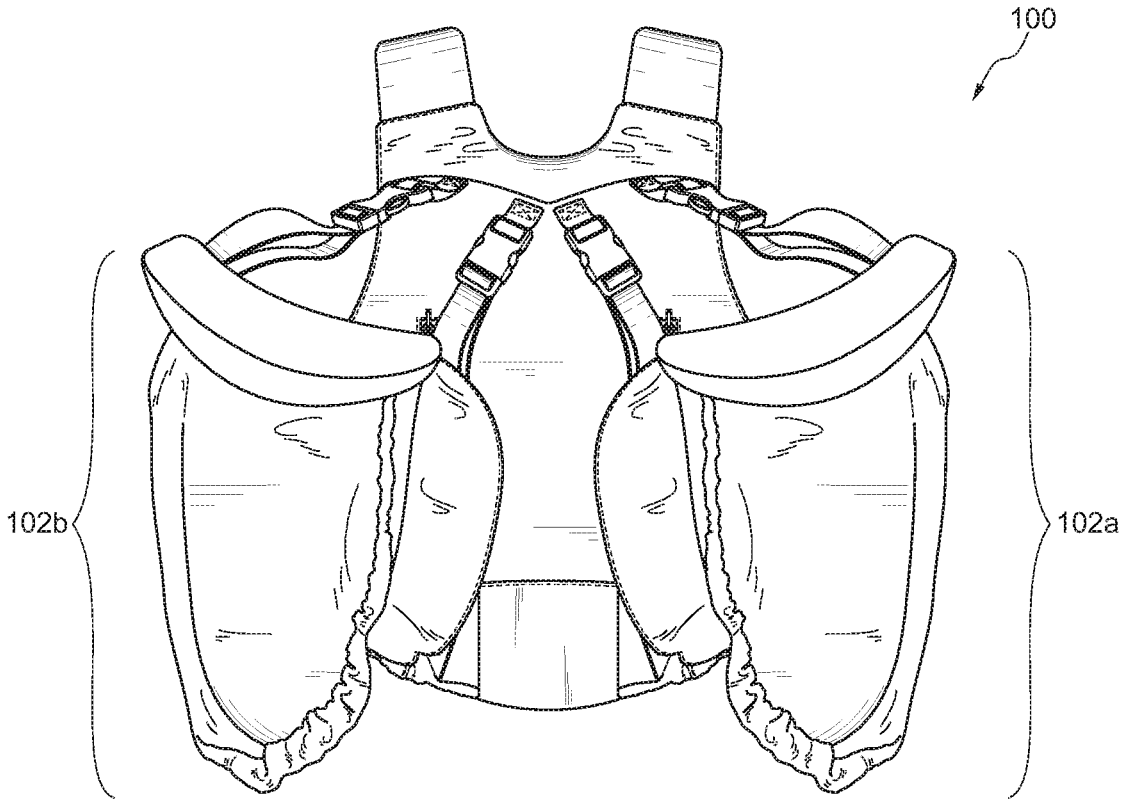
FIG. 1 is a front perspective view of a twin baby carrier apparatus in an engaged configuration, according to an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Figure 2:
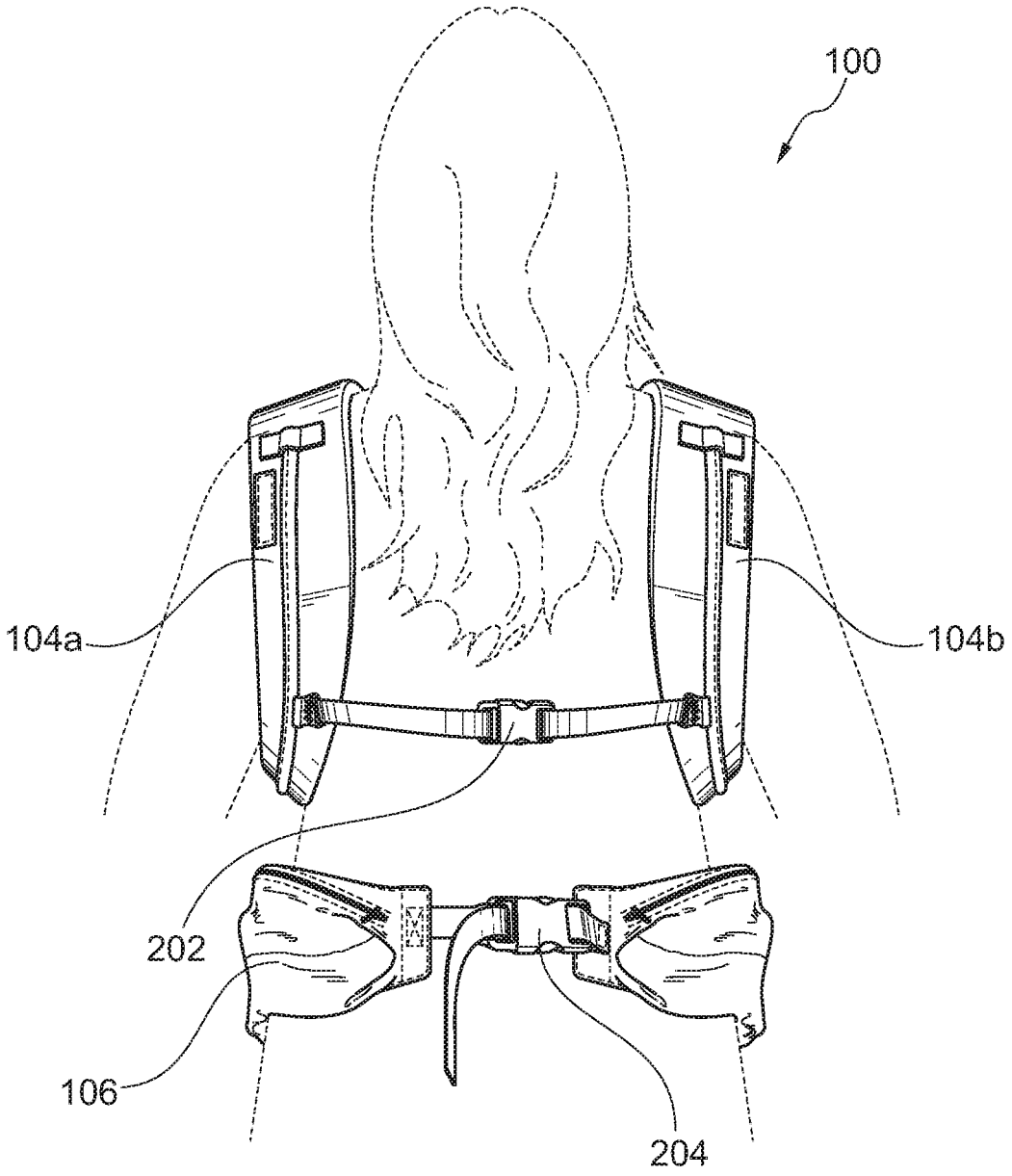
FIG. 2 is a rear perspective view of a twin baby carrier apparatus in an engaged configuration, according to an embodiment of the present disclosure.

Embodiments of the present disclosure provide for a novel twin baby carrier apparatus with enhanced ease of use for holding and removing two infant babies in the same carrier, compared to prior art solutions; and, novel twin baby carrier apparatus with an improved design for carrying two infant babies side-by-side against a user's chest, compared to prior art solutions. Referring now to FIGS. 1 and 2, front and rear perspective views of a twin baby carrier apparatus 100 in an engaged configuration is shown. According to an embodiment of the present disclosure, twin baby carrier apparatus 100 is configured to enable a user to securely and comfortably carry two infant babies on the front side of a user's body. Twin baby carrier apparatus 100 includes a right baby carrier portion 102*a* and a left baby carrier portion 102*b* adjustably coupled to a body portion 112 being selectively coupled to the user's chest. Right shoulder strap 104*a* and left shoulder strap 104*b* are selectively coupled to the user's left and right shoulders (respectively), and selectively secured via shoulder strap connector 202. Shoulder strap connector 202 may have an adjustment tether to enable the user to adjust the fit of right shoulder strap 104*a* and left shoulder strap 104*b* by simply pulling upward on the adjustment tether with one hand. Right shoulder strap 104*a* and left shoulder strap 104*b* may further comprise an adjustment cable, such that shoulder strap connector 202 may be moved upward or downward to improve the fit for a user according to the user's body type. A waist support portion 106 extends from a lower portion of body portion 112 and is configured to wrap around the waist of the user to be selectively coupled behind the user's back via waist support connector 204.

Figure 3:
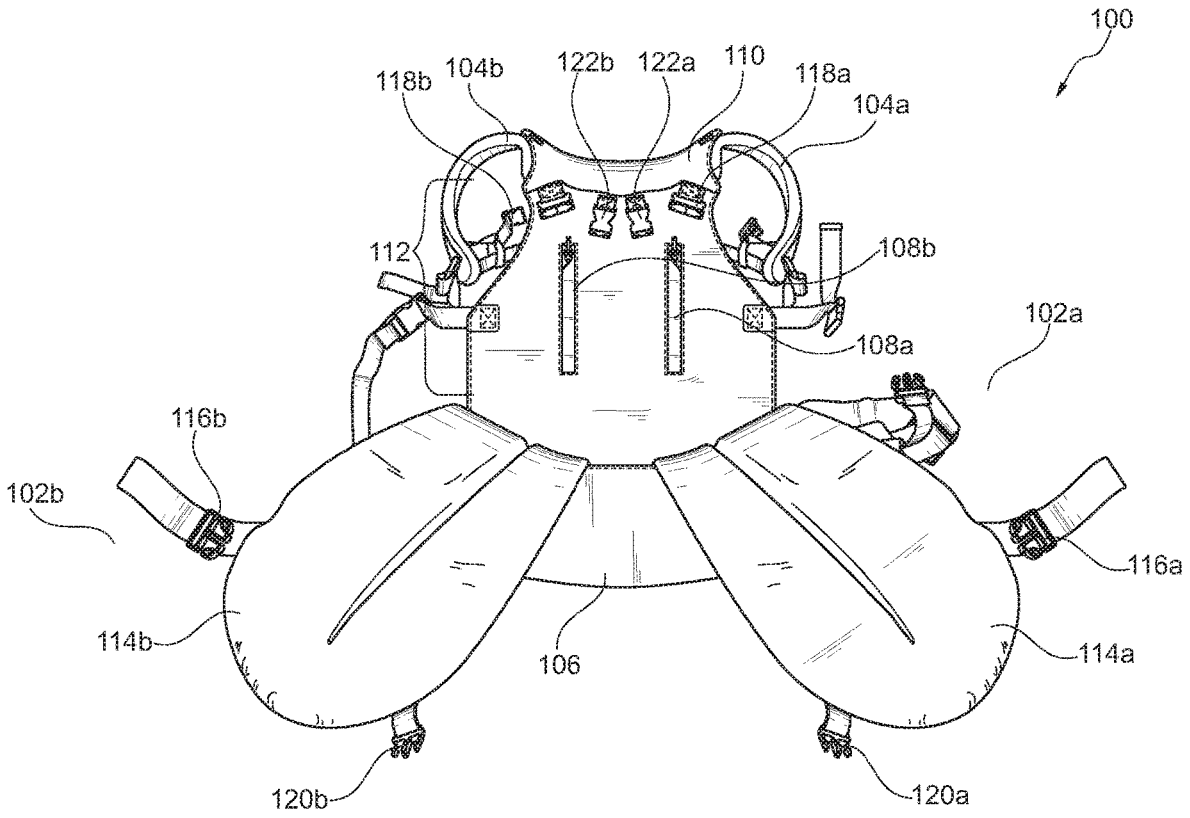
FIG. 3 is a front plan view of a twin baby carrier apparatus in a disengaged configuration, according to an embodiment of the present disclosure.
Figure 4:
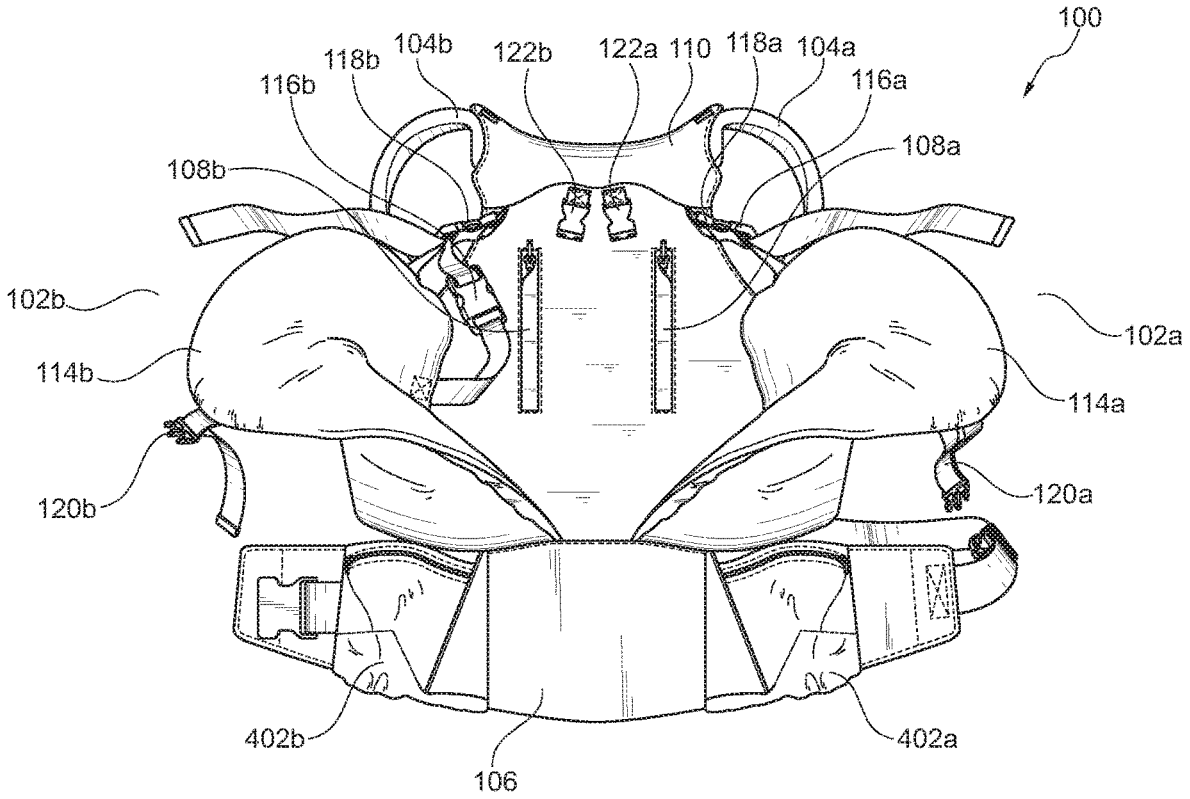
FIG. 4 is a front plan view of a twin baby carrier apparatus in a partially engaged configuration, according to an embodiment of the present disclosure.
Figure 5:
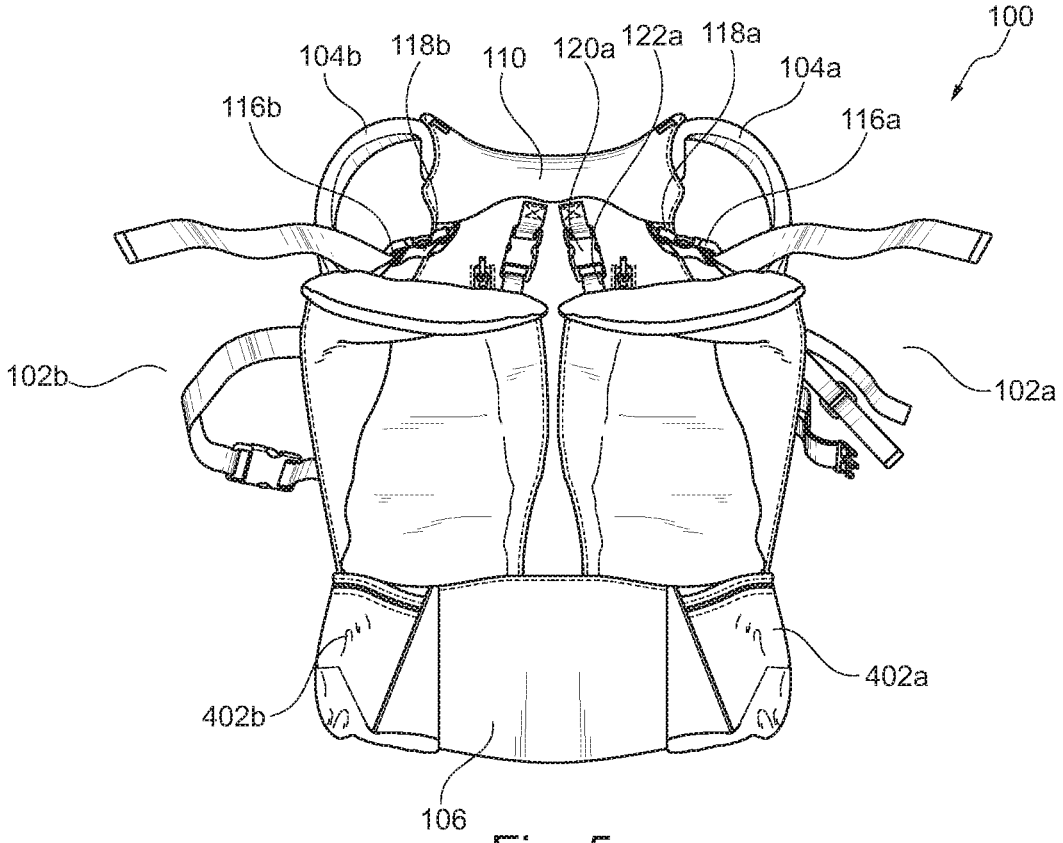
FIG. 5 is a front plan view of a twin baby carrier apparatus in an engaged configuration, according to an embodiment of the present disclosure.

Referring now to FIGS. 3-5, a front plan view of twin baby carrier apparatus 100 is shown. According to an embodiment of the present disclosure, twin baby carrier apparatus 100 is generally comprised of body portion 112, right baby carrier portion 102*a*, left baby carrier portion 102*b*, right shoulder strap 104*a*, left shoulder strap 104*b*, and waist support portion 106. Body portion 112 may be configured to extend from an upper end, being proximal to the user's neck when worn, to a lower end being adjacent to waist support portion 106. Body portion 112 may comprise a right breast access zipper 108*a* and a left breast access zipper 108*b*. Right breast access zipper 108*a* and left breast access zipper 108*b* are configured to expose a right breast access portion and a left breast access portion of body portion 112, such that a user of twin baby carrier apparatus 100 may breastfeed one or both infants when said infants are being held in right baby carrier portion 102*a* or left baby carrier portion 102*b*. Right breast access zipper 108*a* and left breast access zipper 108*b* may be configured vertically, or at an angle. In addition, right breast access zipper 108*a* and left breast access zipper 108*b* may be configured to include one or more flaps, openings and/or attachment means to more comfortably expose the wearer's breast for breast feeding. For example, right breast access zipper 108*a* and left breast access zipper 108*b* may be comprised of a curved opening and flap secured by hook and look fasteners. Body portion 112 may further comprise a right lateral support buckle 118*a* and a right medial support buckle 122*a* disposed on a right side of the upper portion of body portion 112; and, a left lateral support buckle 118*b* and a left medial support buckle 122*b* disposed on a left side of the upper portion of body portion 112. A buckle cover flap 110 may be coupled to the upper perimeter of body portion 112, and is configured to selectively cover right lateral support buckle 118*a*, right medial support buckle 122*a*, left lateral support buckle 118*b*, and left medial support buckle 122*b* to prevent surface contact between a baby's face and said components. Waist support portion 106 may have a right storage pocket 402*a* and a left storage pocket 402*b* disposed thereon.

Still referring to FIGS. 3-5, right baby carrier portion 102*a* and left baby carrier portion 102*b* are tapered in shape from a lower end, being permanently coupled to body portion 112 above waist support portion 106, to an upper end. Right baby carrier portion 102*a* and left baby carrier portion 102*b* may be constructed from a piece of fabric approximately 11 inches in width. The fabric may be gathered at the lower end to approximately six inches in width, and extend to approximately 11 inches in width at the upper end. The lower end may be configured in the range of about four inches to about eight inches; and, the upper end may be configured in the range of about ten inches to about 12 inches. The construction details of right baby carrier portion 102*a* and left baby carrier portion 102*b* are such that right baby carrier portion 102*a* and left baby carrier portion 102*b* are extendable to receive a baby when in use. The upper end of right baby carrier portion 102*a* and left baby carrier portion 102*b* may be curved in shape and configured to be folded outward to create a neck rest portion. Right baby carrier portion 102*a* and left baby carrier portion 102*b* may have a liner 114*a* and 114*b* being constructed from a soft and hypoallergenic material to provide comfort for the baby(ies) when being held in twin baby carrier apparatus 100. Right baby carrier portion 102*a* and left baby carrier portion 102*b* may have a head cover portion that can be selectively coupled to an upper portion of shoulder straps 104*a,b*. Right baby carrier portion 102*a* may have a right lateral support strap 116*a* and a right medial support strap 120*a*. Likewise, left baby carrier portion 102*b* may have a left lateral support strap 116*b* and a left medial support strap 120*b*. Right baby carrier portion 102*a* is configured from a disengaged configuration (as shown in FIG. 3) to an engaged position (as shown in FIG. 5) by first connecting right lateral support strap 116*a* to right lateral support buckle 118*a*, and left lateral support strap 116*b* to left lateral support buckle 118*b* (as shown in FIG. 4). Right medial support strap 120*a* is then connected to right medial support buckle 122*a*, and left medial support strap 120*b* is connected to left medial support buckle 122*b* (as shown in FIG. 5). Support buckles 118 and 122 may be substituted for any commercially viable connection means, such as hook and loop fasteners, mechanical mating components, magnetic mating components, and the like.

To secure a baby within right baby carrier portion 102*a* or left baby carrier portion 102*b*, the user begins with twin baby carrier apparatus 100 in a disengaged position (as shown in FIG. 3). The user holds the baby to the user's chest in contact with body portion 112 and in alignment with right baby carrier portion 102*a* or left baby carrier portion 102*b*. The user then couples right baby carrier portion 102*a* and/or left baby carrier portion 102*b* to body portion 112 as described above (FIGS. 3-5). The user can adjust the size of baby carrier portions 102*a,b* by adjusting lateral support straps 116*a,b* and medial support straps 120*a,b*.

Figure 6:
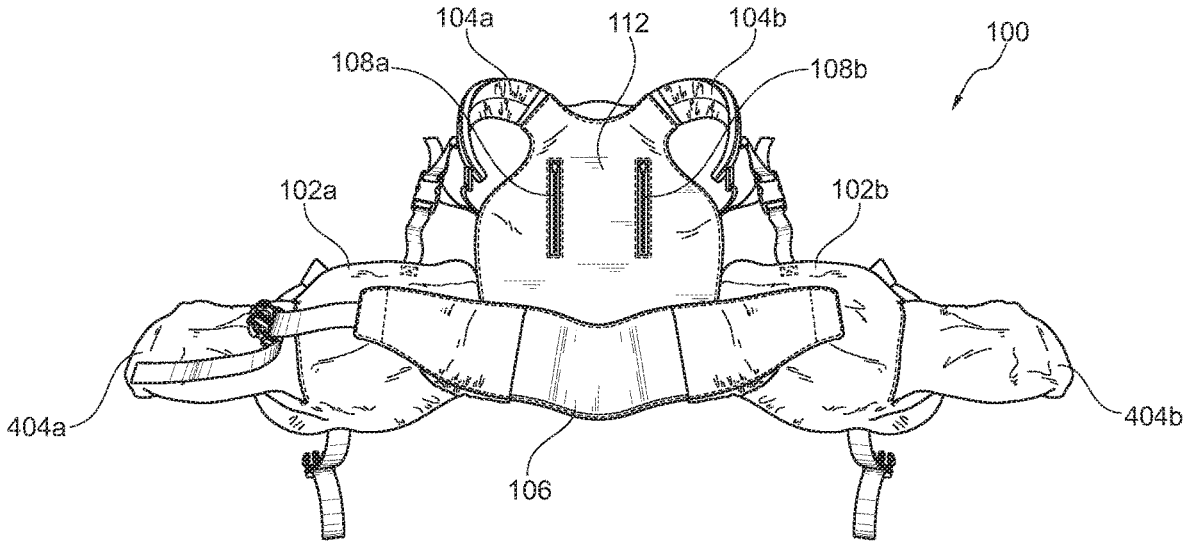
FIG. 6 is a rear plan view of a twin baby carrier apparatus in a disengaged configuration, according to an embodiment of the present disclosure; and, FIG. 7 is a rear plan view of a twin baby carrier apparatus in an engaged configuration, according to an embodiment of the present disclosure.
Figure 7:
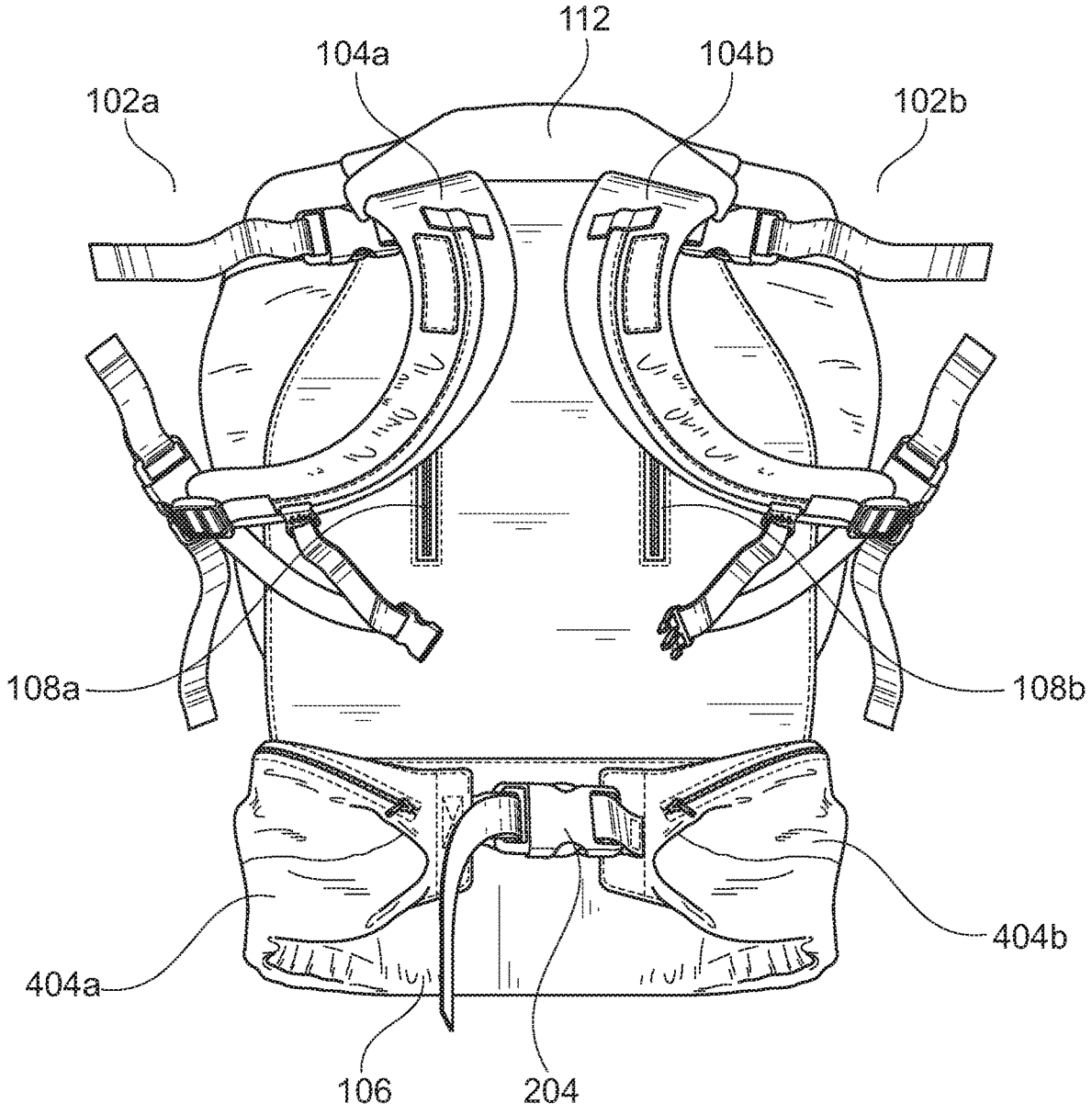

Referring now to FIGS. 6-7, a rear plan view of twin baby carrier apparatus 100 is shown. According to an embodiment of the present disclosure, a user selectively couples twin baby carrier apparatus 100 to the user's torso by placing the user's arm's under shoulder straps 104*a,b* and bringing twin baby carrier apparatus 100 to the user's chest, such that body portion 112 is in contact with the user's chest and shoulder straps 104*a,b* are placed over the user's shoulders. Waist support portion 106 is placed in contact with the user's waist, and is wrapped around the user's waist and secured behind the user's back via waist support connector 204. Right sun shade 404*a* and left sun shade 404*b* extend from an upper portion of right baby carrier portion 102*a* and left baby carrier portion 102*b*, and are configured to be coupled to shoulder straps 104*a,b* via hook and loops fastener(s), or other commercially viable fastener types, to enable the user to selectively cover a carried baby's head from sun or other elements.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A baby carrier apparatus comprising:

a body portion comprising a fabric panel, the body portion having a left medial connector means and a left lateral connector means disposed on an upper perimeter of the body portion, and a right medial connector means, and a right lateral connector means disposed on the upper perimeter of the body portion;

a right shoulder strap coupled to the upper perimeter of the body portion;

a left shoulder strap coupled to the upper perimeter of the body portion;

a waist support portion coupled to a lower portion of the body portion and configured to wrap around the waist of a user when worn;

a right baby carrier portion comprising a fabric panel having an interior surface and an exterior surface, the right baby carrier portion being tapered in shape from a lower end to an upper end, the lower end being coupled to the body portion above the waist portion, the right baby carrier portion having a right medial support strap configured to be selectively coupled to the right medial connector means and a right lateral support strap configured to be selectively coupled to the right lateral connector means;

a left baby carrier portion comprising a fabric panel having an interior surface and an exterior surface, the left baby carrier portion being tapered in shape from a lower end to an upper end, the lower end being coupled to the body portion above the waist portion, the left baby carrier portion having a left medial support strap configured to be selectively coupled to the left medial connector means and a left lateral support strap configured to be selectively coupled to the left lateral connector means;

a sunshade extending from an upper portion of the right baby carrier portion or the left baby carrier portion; and a shoulder strap connector extending between the right shoulder strap and the left shoulder strap, the shoulder strap connector comprising an adjustment tether configured to adjust a fit of both the right shoulder strap and the left shoulder strap simultaneously when pulled upward by the user with one hand when worn by the user, wherein the right shoulder strap and the left shoulder strap further comprise an adjustment cable, wherein the shoulder strap connector is engaged with the adjustment cable such that the shoulder strap connector may be moved upward or downward via the adjustment cable to adjust the fit of the shoulder strap connector when worn by the user.

2. The baby carrier apparatus of claim 1 further comprising a right breast access zipper and a left breast access zipper disposed on the body portion.

3. The baby carrier apparatus of claim 1 wherein the waist support portion further comprises at least one storage pocket.

4. A baby carrier apparatus comprising:

a body portion having at least one breast access opening disposed thereon;

a right shoulder strap coupled to the upper perimeter of the body portion;

a left shoulder strap coupled to the upper perimeter of the body portion;

a waist support portion coupled to a lower portion of the body portion and configured to wrap around the waist of a user when worn;

a right baby carrier portion comprising a fabric panel having an interior surface and an exterior surface, the right baby carrier portion being tapered in shape from a lower end to an upper end, the lower end being coupled to the body portion above the waist portion, the right baby carrier portion being selectively coupled to an upper portion of the body portion;

a left baby carrier portion comprising a fabric panel having an interior surface and an exterior surface, the left baby carrier portion being tapered in shape from a lower end to an upper end, the lower end being coupled to the body portion above the waist portion, the left baby carrier portion being selectively coupled to an upper portion of the body portion;

a sunshade extending from an upper portion of the right baby carrier portion or the left baby carrier portion; and a shoulder strap connector extending between the right shoulder strap and the left shoulder strap, the shoulder strap connector comprising an adjustment tether configured to adjust a fit of both the right shoulder strap and the left shoulder strap simultaneously when pulled upward by the user with one hand when worn by the user;

wherein the right shoulder strap and the left shoulder strap further comprise an adjustment cable, wherein the shoulder strap connector is engaged with the adjustment cable such that the shoulder strap connector may be moved upward or downward via the adjustment cable to adjust the fit of the shoulder strap connector when worn by the user.

5. A baby carrier apparatus comprising:

a body portion comprising a fabric panel;

a right shoulder strap coupled to the upper perimeter of the body portion;

a left shoulder strap coupled to the upper perimeter of the body portion;

a shoulder strap connector extending between the right shoulder strap and the left shoulder strap, the shoulder strap connector comprising an adjustment tether being configured to enable a user to adjust a setting of the shoulder strap connector by pulling the adjustment tether with one hand;

a waist support portion coupled to a lower portion of the body portion and configured to wrap around the waist of the user when worn;

a right baby carrier portion being tapered in shape from a lower end to an upper end, the lower end being coupled to the body portion above the waist portion and the upper end being selectively coupled to an upper portion of the body portion;

a left baby carrier portion being tapered in shape from a lower end to an upper end, the lower end being coupled to the body portion above the waist portion and the upper end being selectively coupled to an upper portion of the body portion; and a sunshade extending from an upper portion of the right baby carrier portion or the left baby carrier portion, wherein the adjustment tether is configured to adjust a fit of both the right shoulder strap and the left shoulder strap simultaneously when pulled upward by the user with one hand when worn by the user, wherein the right shoulder strap and the left shoulder strap further comprise an adjustment cable, wherein the shoulder strap connector is engaged with the adjustment cable such that the shoulder strap connector may be moved upward or downward via the adjustment cable to adjust the fit of the shoulder strap connector when worn by the user.

6. The baby carrier apparatus of claim 5 further comprising at least one breast access opening disposed on the body portion.

* * * * *